US007245993B2

(12) United States Patent
Wilms

(10) Patent No.: US 7,245,993 B2
(45) Date of Patent: Jul. 17, 2007

(54) RAILWAY SYSTEM WITH AT LEAST ONE TRACK, AND METHOD FOR ENCODING DATA FOR TRANSMISSION OVER THE TRACK

(75) Inventor: Gerhard Wilms, Braunschweig (DE)

(73) Assignee: Siemens Aktiengesellschaft, München (DE)

( * ) Notice: Subject to any disclaimer, the term of this patent is extended or adjusted under 35 U.S.C. 154(b) by 84 days.

(21) Appl. No.: 11/211,815

(22) Filed: Aug. 25, 2005

(65) Prior Publication Data

US 2007/0023583 A1 Feb. 1, 2007

(51) Int. Cl.
*G05D 1/00* (2006.01)
*B61L 21/00* (2006.01)

(52) U.S. Cl. ..... 701/19; 246/34 B

(58) Field of Classification Search ..... 701/1, 701/19, 36; 246/34 B, 121
See application file for complete search history.

(56) References Cited

U.S. PATENT DOCUMENTS 4,970,967 A * 11/1990 Burg et al. ..... 104/130.05
5,145,131 A 9/1992 Franke
5,271,584 A 12/1993 Hochman et al.
5,769,364 A 6/1998 Cipollone

* cited by examiner

*Primary Examiner*—Richard M. Camby
(74) *Attorney, Agent, or Firm*—Henry M. Feiereisen

(57) ABSTRACT

A railway system with at least one track having at least two rails and a method for encoding data for this railway system are disclosed. Railway signaling systems are located proximate to the tract for controlling railway cars moving along the rails. The railway system also includes safety systems associated with the railway signaling systems for exchanging data between the safety systems for safely controlling the railway signaling systems. The data are exchanged bidirectionally by signal pulses, whereby digital electrical signals are transmitted via the two electrically conducting rails. For encoding the data, each data point is formed from one or more signal pulses within a predetermined cycle time which is divided into time intervals. The encoding capacity can be enhanced, without significantly increasing the complexity, by using electrical signals that contain the encoded data in each time interval in form of at least one of three different signal states.

20 Claims, 2 Drawing Sheets

RAILWAY SYSTEM WITH AT LEAST ONE TRACK, AND METHOD FOR ENCODING DATA FOR TRANSMISSION OVER THE TRACK

CROSS-REFERENCES TO RELATED APPLICATIONS

This application claims the priority of German Patent Application, Serial No. 10 2005 036 498.5, filed Jul. 28, 2005, pursuant to 35 U.S.C. 119(a)–(d), the subject matter of which is/are incorporated herein by reference.

BACKGROUND OF THE INVENTION

The present invention relates to a railway system with at least one track, and to a method for digital encoding of data for bidirectional transmission over the track.

Nothing in the following discussion of the state of the art is to be construed as an admission of prior art.

Railway systems that detect the presence of track-bound vehicles on a track are known. The tracks are typically comprised of two rails, with the vehicles' wheels and axles that span the rails acting as a shunt between the rails. Railway signals for controlling movement of the railway cars are typically arranged proximate to the tracks. Safety devices are associated with the railway signals and exchange data on a secure data link for controlling the railway signals, whereby the data are exchanged bidirectionally over both rails of the track. For data exchange, digital electrical signals in form of signal pulses, in particular electrical current pulses, are transmitted over the two electrically conducting rails. This principle is also referred to as bidirectional encoded track circuit. Each of the data consists of one or more current pulses transmitted within a cycle time, which is divided into predetermined time intervals. U.S. Pat. No. 5,271,584 describes for example an exchange of data by means of signal pulses. Heretofore, conventional methods suffer shortcomings as data encoding has a relatively small encoding capacity.

It would therefore be desirable and advantageous to provide an improved system and method for encoding data for transmission over railway tracks, to obviate prior art shortcomings and to realize any increase in the encoding capacity, without adding complexity to the system.

SUMMARY OF THE INVENTION

According to one aspect of the present invention, a railway system includes at least one track with at least two rails, a railway signaling system for controlling track-bound vehicles moving along the rails, and a safety system bidirectionally transmitting data comprising data points as electrical signal pulses over the at least two rails for controlling the railway signaling system, wherein the safety system includes an encoder which divides a transmission cycle time into a plurality of time intervals and encodes the data by assigning to a data point a digital signal value having one of at least three different signal states, with each data point being located in a corresponding one of the time intervals.

According to another aspect of the present invention, a method for encoding of data for safely controlling a railway signaling system of a railway system, with the railway system having at least one track with at least two electrically conducting rails for track-bound vehicles, and a safety system associated with the railway signaling system and adapted for bidirectional data exchange, includes the steps of encoding data by assigning at least one digital signal value having one of at least three different signal states to data points of the data, defining a transmission cycle time for the data and dividing the transmission cycle time into a plurality of time intervals, assigning the data points to corresponding time intervals, and transmitting the encoded data points as electrical signal pulses over the at least two rails.

The present invention resolves prior art shortcomings by essentially providing electrical signals which include encoded data within each time interval in the form of one of at least three different logical signal states.

According to another feature of the present invention, the electrical signals can assume the logical states 1, 0, or −1.

According to another feature of the present invention, the encoding capacity can be increased if the logical signal states can assume logical states 1; 0.33; −0.33; or −1.

According to another feature of the present invention, the safety of the system and method, when receiving and/or interpreting the signal, can be increased if the electrical signals include an identifying pulse having a negative or a positive polarity, regardless of a polarity of a following signal. In other words, the following signal values can have either a negative or a positive polarity. The identification pulse need not be the first signal value in a time interval, but can be any other predetermined signal value, for example the second or third signal value. The polarity should be a selected so that the DC component is reduced, for example, to a value close to zero.

The safety of the system can be further improved by using the level of the first signal value as a reference signal. The reference signal can correspond to the logical signal state +1, but may also correspond to a logical signal state −1.

According to another feature of the present invention, the electrical signals can be current pulses, with the data transmission operating as an encoded track circuit.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
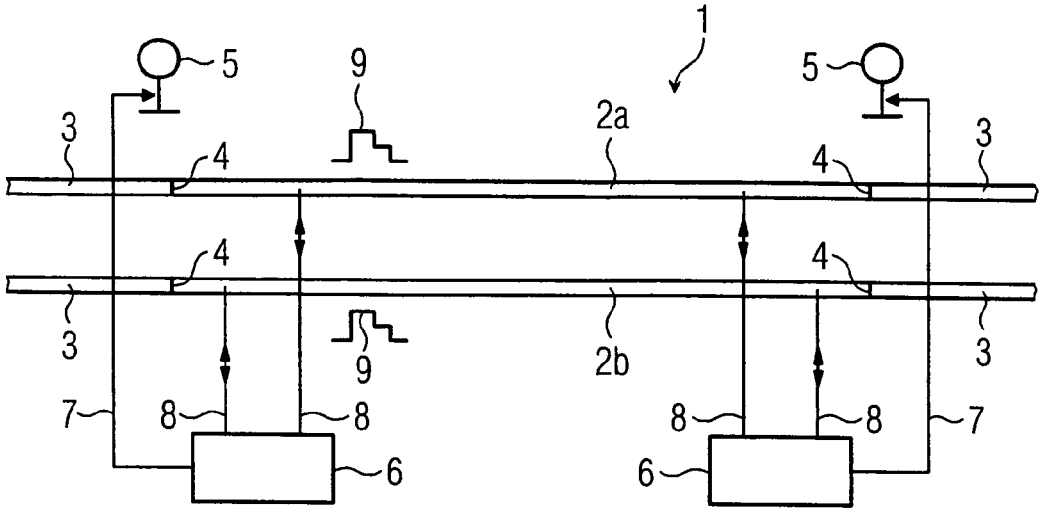
FIG. 1 is a schematic illustration of a railway system according to the present invention, depicting in detail a bidirectional encoded track circuit.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of a railway system according to the present invention, including a track section 1 which is comprised of two rails 2*a*, 2*b*. The two rails 2*a*, 2*b* of track section 1 are electrically insulated from rails 3 of the continuous track by insulators 4 (insulation joints). Disposed in the area of the insulators 4 are two railway signaling systems 5 which control track-bound vehicles traveling along the rails 2*a*, 2*b*, 3. The railway signaling systems 5 are controlled via electric links 7 by safety devices 6 operatively connected to the railway signaling systems 5 in one-to-one correspondence. The safety devices 6 are electrically connected via lines 8 with the electrically conducting rails 2*a*, 2*b*. Consequently, ternary electrical signals 9 can be transmitted from one safety device 6 of the track section 1 to the other safety device 6 via signal pulses 11, (FIGS. 2 and 3), which presently preferred are in the form of current pulses. The safety devices 6 include hereby unillustrated transmitters and receivers.

This type of signal transmission, wherein signal pulses 11 are transmitted in form of electrical current pulses, is also referred to as a bidirectional encoded track circuit. Bidirectional data exchange between the safety devices 6 by way of current pulses requires encoding of the transmitted data.

Figure 2:
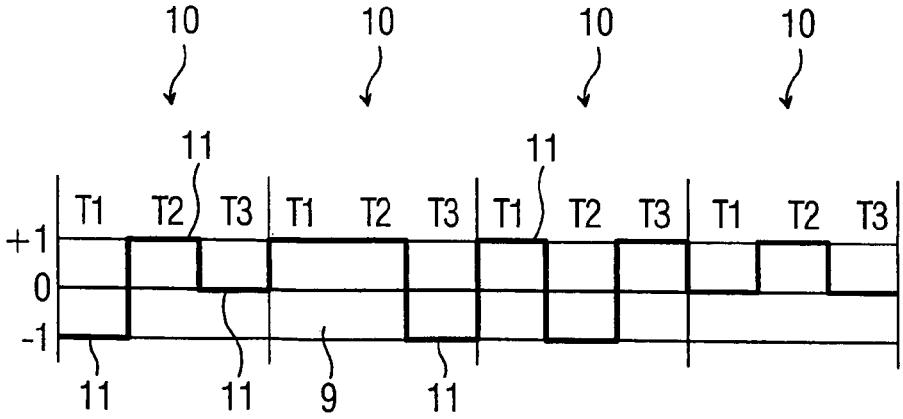
FIG. 2 is a timing diagram showing a ternary electrical signal; in accordance with the present invention.

FIG. 2 shows signal pulses 11 encoded as a ternary signal 9, wherein the encoded data can assume the logical signal states −1, 0, and +1. FIG. 2 shows four transmission cycle times 10, with each of transmission cycle times 10 being divided into three time intervals T1, T2, T3. The signal 9 includes three levels of value, namely the three signal states −1, 0, +1, whereby each time interval T1, T2, T3 and therefore each transmission cycle (transmission cycle and receive cycle together correspond to two cycle times) may be any one of the three signal states. For example, referring again to FIG. 2, the left time interval T1 of signal 9 has the signal state −1, followed by the signal state +1 in the time interval T2 and the signal state 0 in the time interval T3.

It will be understood by those skilled in the art that the signals can also have more than three logical signal states, for example the states 1; 0.33; −0.33; −1.

The states −1 and +1 in FIG. 2 indicate different polarities of the current pulses, regardless of their actual amplitudes.

Figure 3:
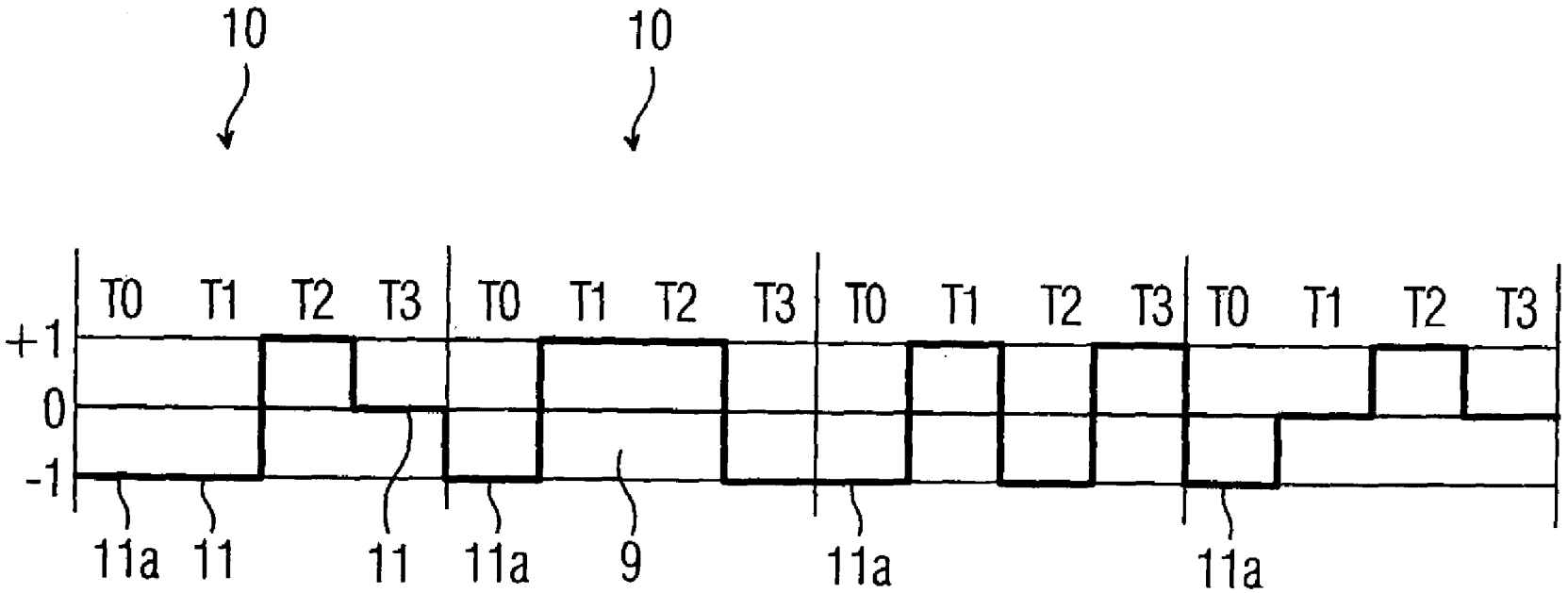
FIG. 3 is a timing diagram showing a ternary electrical signal with an identification pulse.

FIG. 3 shows another ternary electrical signal 9, wherein a first current pulse 11*a* (time interval T0) within each of the cycle times 10 has a negative polarity regardless of the polarity of the following signal pulses 11, which in this embodiment are current pulses. As a consequence, the first current pulse 11*a* can be used as an identification pulse to thereby increase the safety aspect of the data transmission. Of course, the identification pulse 11*a* can also have a positive polarity, without departing from the spirit of the present disclosure. The polarity should be selected so as to reduce the average DC component of the transmitted signal. As an alternative, it is certainly conceivable that provide as identification pulse a different predetermined signal pulse 11, for example the second or third signal pulse.

In the railway system of FIG. 1, the level of the first current pulse can be used as a reference signal, for example, to provide a reference for the signal amplitude. In the depicted exemplary embodiment, the reference signal defines the signal state −1.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method for encoding of data for safely controlling a railway signaling system of a railway system, wherein the railway system includes at least one track with at least two electrically conducting rails for track-bound vehicles, and a safety system associated with the railway signaling system and adapted for bidirectional data exchange, said method comprising:

encoding data by assigning at least one digital signal value having one of at least three different signal states to data points of the data;

defining a transmission cycle time for the data and dividing the transmission cycle time into a plurality of time intervals;

assigning the data points to corresponding time intervals; and transmitting the encoded data points as electrical signal pulses over the at least two rails.

2. The method of claim 1, wherein the signal state is represented by one of a logical signal state 1, 0, and −1.

3. The method of claim 1, wherein the signal state is represented by one of a logical signal state 1, 0.33, −0.33, and −1.

4. The method of claim 1, wherein the electrical signals comprise an identifying pulse having one of a negative or a positive polarity, independent of a polarity of a following signal value.

5. The method of claim 4, wherein the identifying pulse is the first signal pulse of the electrical signals within the transmission cycle time.

6. The method of claim 5, wherein a signal level of the first electrical signal value is used as a reference signal.

7. The method of claim 6, wherein the signal level of the reference signal corresponds to a logical signal state of 1.

8. The method of claim 5, wherein the signal level of the reference signal corresponds to a logical signal state of −1.

9. The method of claim 1, wherein the electrical signals are current pulses, with the data transmission operating as an encoded track circuit.

10. The method of claim 9, wherein the electrical signals are encoded so that a time-averaged DC current is substantially equal to zero.

11. A railway system, comprising:

at least one track with at least two rails, a railway signaling system for controlling track-bound vehicles moving along the rails, and a safety system bidirectionally transmitting data comprising data points as electrical signal pulses over the at least two rails for controlling the railway signaling system, wherein the safety system includes an encoder which divides a transmission cycle time into a plurality of time intervals and encodes the data by assigning to a data point a digital signal value having one of at least three different signal states, with each data point being located in a corresponding one of the time intervals.

12. The railway system of claim 11, wherein the signal state is represented by one of a logical signal state 1, 0, and −1.

13. The railway system of claim 12, wherein the signal state is represented by one of a logical signal state 1, 0.33, −0.33, and −1.

14. The railway system of claim 12, wherein the electrical signals comprise an identifying pulse having a negative polarity or a positive polarity, independent of a polarity of a following signal value.

15. The railway system of claim 14, wherein the identifying pulse is a first signal pulse of the electrical signals within the transmission cycle time.

16. The railway system of claim 15, wherein a signal level of the first electrical signal value is used as a reference signal.

17. The railway system of claim 16, wherein the signal level of the reference signal corresponds to a logical signal state of 1.

18. The railway system of claim 16, wherein the signal level of the reference signal corresponds to a logical signal state of −1.

19. The railway system of claim 12, wherein the electrical signals are current pulses, with the data transmission operating as an encoded track circuit.

20. The railway system of claim 19, wherein the electrical signals are encoded so that a time-averaged DC current is substantially equal to zero.

* * * * *

UNITED STATES PATENT AND TRADEMARK OFFICE

CERTIFICATE OF CORRECTION

PATENT NO. : 7,245,993 B2
APPLICATION NO. : 11/211815
DATED : July 17, 2007
INVENTOR(S) : Gerhard Wilms It is certified that error appears in the above-identified patent and that said Letters Patent is hereby corrected as shown below:

Please indicate priority data as claimed in the application:

On the Title Page, should read,

Item --[30] Foreign Application Priority Data

July 28, 2005 (DE) ..... 10 2005 036 498.5--

Signed and Sealed this

Seventeenth Day of June, 2008

JON W. DUDAS
*Director of the United States Patent and Trademark Office*